US005944096A

United States Patent [19]

Hubert

[11] Patent Number: 5,944,096

[45] Date of Patent: Aug. 31, 1999

[54] TWO-PART HEADER FOR A CONDENSER

[75] Inventor: Sylvain Hubert, Reims, France

[73] Assignee: Valeo Thermique Moteur, La Verriere, France

[21] Appl. No.: 08/998,471

[22] Filed: Dec. 26, 1997

[30] Foreign Application Priority Data

Dec. 23, 1996 [FR] France ..... 96 15878

[51] Int. Cl.[6] ..... F28F 9/02

[52] U.S. Cl. ..... 165/175; 165/173; 29/890.052

[58] Field of Search ..... 165/153, 173, 165/175; 29/890.052; 138/157, 162, 166, 167, 171

[56] References Cited

U.S. PATENT DOCUMENTS 5,036,914 8/1991 Nishishita et al. .
5,092,398 3/1992 Nishishita et al. ..... 165/153
5,125,454 6/1992 Creamer et al. ..... 165/173
5,127,466 7/1992 Ando ..... 165/173 X
5,363,911 11/1994 Velluet et al. ..... 165/173

FOREIGN PATENT DOCUMENTS 709 642 10/1995 European Pat. Off. .
40 04 949 8/1990 Germany .

*Primary Examiner*—Leonard Leo
*Attorney, Agent, or Firm*—Morgan & Finnegan LLP

[57] ABSTRACT

A condenser for a motor vehicle air conditioning installation includes a fluid header in two parts, comprising an upper profiled element and a lower profiled element which are assembled together through their respective marginal regions. The marginal regions of the two elements are snap fitted together so as to hold them together before brazing.

12 Claims, 1 Drawing Sheet

TWO-PART HEADER FOR A CONDENSER

FIELD OF THE INVENTION

This invention relates to fluid headers for a heat exchanger, especially a condenser in an air conditioning apparatus for a vehicle, in which the header comprises a tubular wall extending in a longitudinal direction, and at least two terminal walls defining, within the tubular wall, a space for receiving a flowing fluid.

The tubular wall comprises two profiled elements which are formed from strips of metal sheet curved substantially into the form of a gutter, the concavities of which face towards each other. Two marginal regions of one of the elements are in sealed contact with the two marginal regions, respectively, of the other element over the whole length of the space.

One of the said elements has apertures aligned in the longitudinal direction for receiving, in the apertures, fluid flow tubes communicating with the space.

BACKGROUND OF THE INVENTION

In fluid headers (sometimes known as collecting boxes) of this type, fastening together the two profiled elements of the header, and sealing between their marginal regions, are usually ensured by brazing. For this purpose, after the components of the heat exchanger have been fully assembled together, a brazing material is melted. This material is present as a coating on the profiled elements and on the other components of the heat exchanger. This gives, in particular, all at the same time, the required sealed connection between the fluid flow tubes and the corresponding profiled elements, together with that between the terminal walls and the tubular wall of the header.

During handling operations prior to the brazing operations, it is necessary that the two profiled elements keep the relative positions which they have got to have in the complete header. European patent specification number EP 375 896 A describes a fluid header in which the marginal regions of one of the profiled elements are parallel to each other and are either inserted in rebates formed in the marginal regions of the other element, or are in flat overlying relationship with these last mentioned marginal regions. In order to immobilize the two elements with respect to each other before the brazing operation, their marginal regions are "riveted" by means of local deformations, with projections thus formed by one of the elements engaging, as required, in apertures formed in the other element.

DISCUSSION OF THE INVENTION

The object of the invention is to simplify the assembly of the fluid header, by omitting the riveting step discussed above.

According to the invention, in a first aspect, a fluid header for a heat exchanger is, provided i.e. a condenser in an air conditioning apparatus for a vehicle, in which the header comprises a tubular wall extending in a longitudinal direction, and at least two terminal walls defining, within the tubular wall, a space for receiving a flowing fluid, the tubular wall comprising two profiled elements which are formed from strips of metal sheet, each curved substantially into the form of a gutter, the concavities of which face towards each other, with two marginal regions of one of the elements being in sealed contact with the two marginal regions, respectively, of the other element over the whole length of the space, one of the elements having apertures aligned in the longitudinal direction for receiving in the apertures, fluid flow tubes communicating with the space, wherein, over the whole length of the tubular wall and in at least a first zone at the level of the marginal regions, the outer faces of the marginal regions of a first one of the profiled elements are divergent towards the free edges of the marginal regions, the outer faces cooperating with the inner faces of the marginal regions of the second profiled element, which are convergent towards the free edges of the marginal regions of the second element, to maintain the two elements in gripping relationship with each other.

In this specification, the term "height" refers to the direction in which the two gutters defined by the two elements of the fluid header face towards each other, or to the longitudinal direction of the fluid flow tubes, regardless of the orientation of the fluid header in the space.

In various preferred embodiments of the invention, either the said first zone is adjacent to the free edges of the first profiled element, or the first zone is adjacent to the free edges of the second profiled element, or both.

According to a preferred feature of the invention, in a second zone at the level of the marginal regions, further away than the first zone from the free edges of the first element, the outer faces in the marginal regions of the first element are convergent towards the free edges of the those marginal regions, and cooperate with the inner faces in the marginal regions of the second element, which are divergent in the second zone towards the free edges of the second element, to maintain the mutual spacing between the bases of the gutters defined by the two elements of the tubular wall.

Preferably, the divergence of the outer face of each marginal region of the first profiled element towards the free end of the second element is defined by a local variation in the wall thickness of that marginal region, the inner faces of the marginal regions being parallel to each other in the first zone.

The fluid header includes at least one transverse partition in the form of a flat plate, the profile of which substantially matches the internal profile of the tubular wall, with each transverse partition constituting one of the terminal walls or an intermediate wall separating two chambers, from each other, within the space.

Preferably, the peripheral edge of the profile for each transverse partition has, facing towards the marginal regions, reliefs cooperating with a corresponding profile of the first profiled element, to hold the partition in place between the base of the gutter defined by the first element independently of the presence of the second element.

According to the invention in a second aspect, a heat exchanger comprises at least one fluid header according to the invention, as defined above, together with a row of fluid flow tubes, each of which is engaged in one of the apertures.

According to the invention in a third aspect, in a method of assembling a heat exchanger according to the invention: the two profiled elements of the tubular wall are disposed in relation to each other with their concavities in facing relationship; the two profiled elements are displaced towards each other, with their marginal regions being engaged elastically so as to come into snap fitted relationship; the row of tubes is engaged in the apertures; and the assembly is brazed.

Preferably, in the method of the invention, the peripheral edge of the profile for each transverse partition is fitted in place in the first element before the first element is displaced towards the second element.

According to another preferred feature of the invention, after the peripheral edge of the profile for each transverse partition has been fitted in the first element, it is fastened there by displacing the marginal regions of the elements towards each other.

Further features and advantages of the invention will appear more clearly on a reading of the following detailed description of some preferred embodiments of the invention, which are given by way of non-limiting example only and with reference to the accompanying drawings.

DESCRIPTION OF PREFERRED EMBODIMENTS OF THE INVENTION

Figure 1:
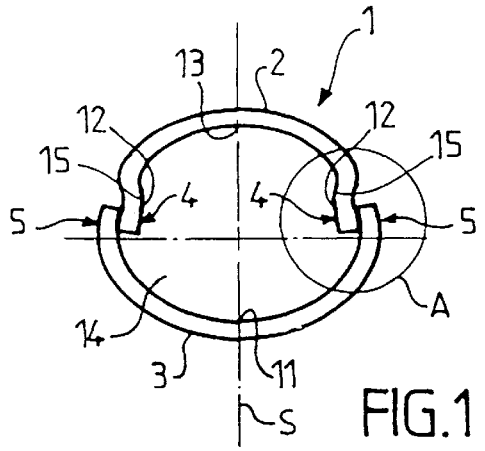
FIG. 1 is an end view of the tubular wall of a fluid header, according to one embodiment of the invention, having a transverse partition.
Figure 1A:
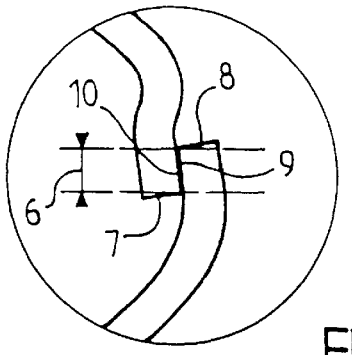
FIG. 1*a* shows an enlarged view of Section A of in FIG. 1.

The tubular wall 1 shown in FIGS. 1 and 1*a* consists of two profiled elements 2 and 3, each of which is formed from a strip of metal sheet which is curved substantially in the form of a gutter. These two elements are assembled together through their respective marginal regions 4 and 5, with the concavity of each marginal region facing towards the other. The profile for the elements 2 and 3, and the closed profile of the tubular wall 1 which they together form, are symmetrical with respect to an axis of symmetry S which is oriented vertically in the drawing, and which intersects the midpoint, or base (11,13), of each gutter defined by the elements 2 and 3. A transverse zone 6 has a depth along the axis S equal to that of the marginal regions 4 and 5 of the elements 2 and 3 (which are terminated by the free edges 7 of the element 2 and the free edges 8 of the element 3 respectively). In this zone 6, the outer faces of the marginal regions 4 of the element 2 are divergent towards the free edges 7, while the inner faces 10 of the marginal regions 5 of the element 3 are convergent towards the free edges 8. In other words, the faces 9 of the element 2, the concavity of which faces downwards, and the faces 10 of the element 3, the concavity of which faces upwards, are all inclined towards the axis S when considered upwardly. The faces 10 are in engagement on the faces 9, as a result of which the two elements 2 and 3 are in a mutual gripping relationship which holds them together.

The elements 2 and 3 are curved by a press forming operation, and have a substantially constant wall thickness. The internal width of the element 3, which increases from the free edges 8 of the element 3 to the free edges 7 of the element 2, continues to increase below the edges 7, up to a maximum value, and then diminishes progressively to zero at the base 11 of the gutter defined by the element 3. The internal width of the element 2 diminishes in the upward direction from its free edges 7, down to a minimum value defined by crests 12 formed during the press forming operation, and then increases to a maximum value, to diminish progressively down to the base 13 of the gutter constituted by the element 2.

The fluid header has intermediate partitions 14 in the form of flat plates, the profiles of which match the internal profile of the tubular wall 1. These partitions are formed with reliefs 15 for receiving the crests 12. There is, thus, mating cooperation between the element 2 and the partitions 14, as a result of which the partitions are held in place against the inside face of the element 2 in the absence of the element 3.

Fitting of the 14 partitions within the element 2 can be carried out by snap fitting, in which the marginal regions of the element 2 are pulled further away from each other while the partitions 14 are pushed towards the base 13 of the element 2. The elements 2 and 3 can then be assembled, by snap fitting them together, with resilient spreading apart of the marginal regions 5 of the element 3 while the bases 13 and 11 of the two elements are pushed towards each other. The movement of the elements 2 and 3 towards each other is limited by the internal face of the element 3 coming into abutment on the peripheral edge of the partitions 14. Any movement in the reverse direction is prevented by the cooperation of the marginal regions 4 and 5 of the two elements with each other as described above.

In any known way, the profiled element 3 is formed with apertures for receiving fluid flow tubes, not shown.

Figure 2:
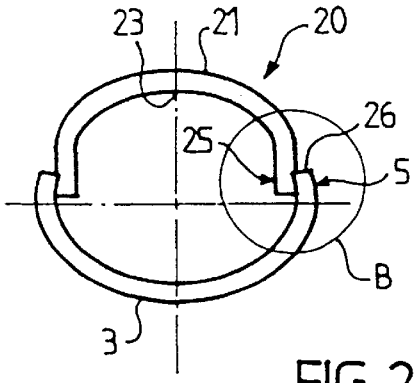
FIG. 2 is an end view of the tubular wall of a fluid header, according to a second embodiment of the invention, having a transverse partition.
Figure 2A:
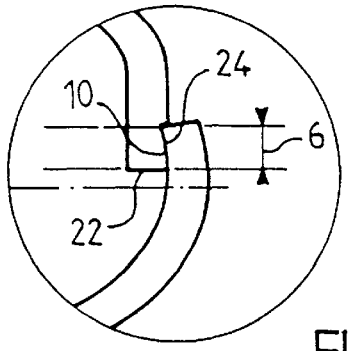
FIG. 2*a* shows an enlarged view of section B of FIG. 2.

In FIGS. 2 and 2*a*, the tubular wall, here denoted by the reference numeral 20, consists of two profiled elements, namely the lower element 3 and an upper element 21. However, in this case, although the lower element 3 is identical to the element 3 in FIG. 1, in FIG. 2 the upper element 21 is different from the element 2. From the free edges 22 of the upper element 21, the internal width of the upper element 21 remains constant up to a certain height, after which it decreases continuously to zero at the base 23 of the element 21. In order to form, in the contact zone 6 between the two elements 21 and 3, an inclined external face 24 of each marginal region 25 of the upper element 21, co-operating with the inclined inner face 10 of the corresponding marginal region 5 of the element 3, the outer faces 24 are coined before the press forming operation, so as to progressively reduce the wall thickness of the marginal regions 25, in an inward taper extending from the free edge 22 of the element 21. The absence of a minimum in the internal width of the element 21 does not enable the transverse partitions to be snap fitted, so that the partitions 14 are instead held in place by seaming them to the element 21. The remaining assembly operations are the same as in the embodiment of FIG. 1.

The tubular wall 30 shown in FIG. 3 comprises an upper element 2 which is substantially identical to that described with reference to FIGS. 1 and 1*a*, together with a lower element 31. The element 31 differs from the element 3 of FIGS. 1 and 2 in that, in a further transverse zone 32 at the level immediately above the zone 6, the inner faces 33 of its marginal regions 34 are divergent up to the free edges 35 of the element 31, to cooperate with the upwardly divergent outer faces 9 of the marginal regions 4 in the element 2, so that the marginal regions 4 and 34 are in mutually gripping relationship. This cooperation of the faces in the zone 32 limits the movement of the two elements 2 and 31 towards each other in the vertical direction, even in the absence of any transverse partition.

Figure 3:
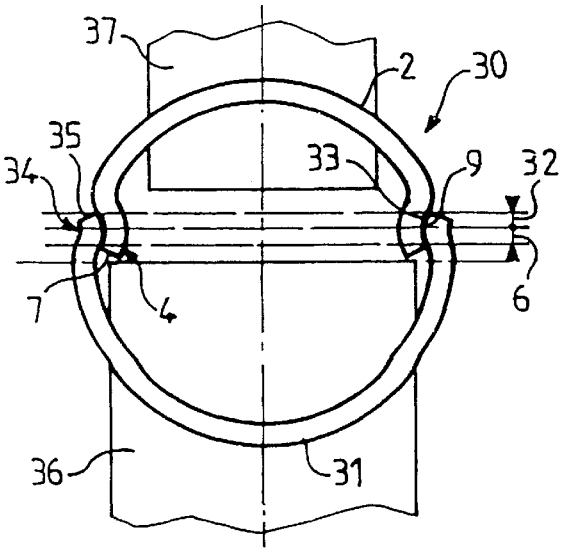
FIG. 3 is a cut away showing part of a condenser, in accordance with the invention, with a third embodiment the tubular wall of a fluid header being shown in transverse cross-section.

FIG. 3 also shows a fluid flow tube 36 which is engaged in an aperture in the lower element 31, with the end of the tube 36 being in abutment against the free edges 7 of the upper element 2. A tubular inlet or outlet connection 37 extends through another aperture formed in the upper element 2.

Figure 4:
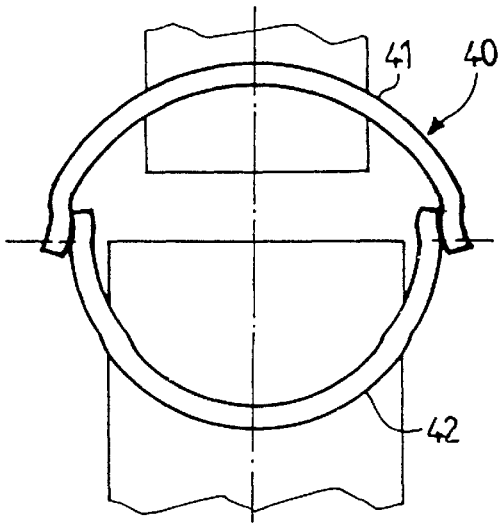
FIG. 4 is a view similar to FIG. 3, for a condenser, according to a fourth embodiment of the invention.

With reference now to FIG. 4, the upper profiled element 41 and the lower profiled element 42 shown in this further embodiment have profiles similar to those of the elements 2 and 31 in FIG. 3. The essential difference is that the marginal regions of the upper element 41 overlap those of the lower element 42 on the outside instead of on the inside. In other words, it is the inner faces of the marginal regions of the upper element 41 that cooperate with the outer faces in the marginal regions of the lower element 42. As a result, any transverse partitions must be fitted on the lower element before the two elements 41 and 42 are assembled together. Apart from this, the assembly operations are unchanged.

What is claimed is:

1. A fluid header for a heat exchanger, the fluid header comprising a tubular wall having a length extending in a longitudinal direction, the tubular wall defining a space for receiving a flowing fluid and comprising:

a first curved profiled element in a facing relation with a second curved profiled element, each said profiled element terminating at free edges and having two marginal regions, a first marginal region at one side of the profiled element and a second marginal region at an opposite side of the profiled element, each said marginal region comprising an outer face, an inner face, and a free edge joining the outer face and the inner face, wherein each marginal region of the first profiled element contacts a corresponding marginal region of the second profiled element over the length of the tubular wall thereby defining a cooperating pair of marginal regions, wherein one of the profiled elements includes a plurality of apertures aligned in the longitudinal direction, wherein the tubular wall defines a first zone extending transverse to the longitudinal direction and intersecting the marginal regions, wherein the outer faces of the marginal regions of the first profiled element diverge towards the free edges of the first profiled element and cooperate with the inner faces of the marginal region of the second profiled element, the marginal regions of the second profiled element converging towards the free edges of the second profiled element.

2. A fluid header according to claim 1, wherein the first zone is adjacent to the free edges of the first profiled element.

3. A fluid header according to claim 1, wherein the first zone is adjacent to the free edges of the second profiled element.

4. A fluid header according to claim 1, wherein each of said profiled elements defines a base of a gutter and the fluid header further defines a second zone, wherein the first zone is between the free edges of the first profiled element and the second zone, the outer faces of the marginal regions of the first profiled element converge in the second zone towards the free edges of the marginal regions of the first profiled element and cooperate with the inner faces of the marginal regions of the second profiled element, and the inner faces of the marginal regions of the second profiled element diverge towards the free edges of the second profiled element.

5. A fluid header according to claim 1, wherein the inner faces of the marginal regions of the first profiled element are parallel to each other in the first zone, each of the marginal regions of the first profiled element being of varying thickness thereby defining a divergence of each of the outer faces of the marginal regions of the first element.

6. A fluid header according to claim 1, further including at least one transverse partition having a contour substantially matching an internal profile of the tubular wall and defining an end of at least one chamber within the space.

7. A fluid header according to claim 6, wherein said partition has a peripheral edge with reliefs facing the marginal regions, each of the marginal regions of the first profiled element having a profile matching said reliefs.

8. A method of assembling a heat exchanger having a fluid header according to claim 6, comprising:

disposing the first profiled element alongside the second profiled element with said profiled elements facing each other;

displacing the first profiled element towards the second profiled element until said marginal regions of said profiled elements are engaged into a snap fitted relationship;

engaging said fluid flow tubes in said apertures; and brazing the assembled heat exchanger.

9. A method according to claim 8, before said displacing, further including fitting at least one said partition into the first profiled element.

10. A method according to claim 9, after said fitting, further including securing at least one said partition in place.

11. A heat exchanger comprising at least one fluid header according to claim 1, wherein a plurality of fluid flow tubes is engaged in the apertures.

12. A method of assembling a heat exchanger according to claim 11, comprising:

disposing the first profiled element alongside the second profiled element with said profiled elements facing each other;

displacing the first profiled element towards the second profiled element until said respective marginal regions of said profiled elements are engaged into a snap fitted relationship;

engaging said fluid flow tubes in said apertures; and brazing the assembled heat exchanger.

* * * * *